US005992972A

United States Patent [19]

Nagoshi et al.

[11] Patent Number: 5,992,972

[45] Date of Patent: Nov. 30, 1999

[54] MULTIPLE SCAN MIXED COLOR INK JET RECORDING METHOD

[75] Inventors: Shigeyasu Nagoshi, Kawasaki; Hiromitsu Hirabayashi; Noribumi Koitabashi, both of Yokohama; Hitoshi Sugimoto, Kawasaki; Miyuki Matsubara, Tokyo; Fumihiro Gotoh, Yokohama; Masaya Uetuki, Kawasaki, all of Japan

[73] Assignee: Canon Kabushiki Kaisha, Tokyo, Japan

[21] Appl. No.: 08/632,737

[22] Filed: Apr. 15, 1996

Related U.S. Application Data

[63] Continuation of application No. 08/125,203, Sep. 23, 1993, abandoned.

[30] Foreign Application Priority Data

Sep. 25, 1992 [JP] Japan ..... 4-256559

[51] Int. Cl.[6] ..... B41J 2/21; B41J 29/38

[52] U.S. Cl. ..... 347/43; 347/9; 347/12

[58] Field of Search ..... 347/43, 39, 37, 347/15, 12, 9; 358/502; 395/109

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,631,548 | 12/1986 | Milbrandt | 347/15 |
| 4,723,129 | 2/1988 | Endo et al. . | |
| 4,740,796 | 4/1988 | Endo et al. . | |
| 4,748,453 | 5/1988 | Lin et al. . | |
| 4,967,203 | 10/1990 | Doan et al. . | |
| 4,978,971 | 12/1990 | Goetz et al. | 347/5 |
| 5,012,257 | 4/1991 | Lowe et al. . | |
| 5,079,571 | 1/1992 | Eriksen | 347/43 |
| 5,594,478 | 1/1997 | Matsubara et al. | 347/9 X |

FOREIGN PATENT DOCUMENTS

| | | | |
|---|---|---|---|
| 0420399 | 4/1991 | European Pat. Off. . | |
| 0455389 | 11/1991 | European Pat. Off. . | |
| 58-194541 | 11/1983 | Japan . | |
| 59-123670 | 7/1984 | Japan . | |
| 59-138461 | 8/1984 | Japan . | |
| 58-128415 | 1/1985 | Japan | 347/43 |
| 60-199662 | 10/1985 | Japan | 347/43 |
| 60-253551 | 12/1985 | Japan . | |
| 63-242642 | 10/1988 | Japan | 347/43 |
| 1-053852 | 3/1989 | Japan | B41J 3/04 |
| 01281944 | 11/1989 | Japan . | |

*Primary Examiner*—David F. Yockey
*Assistant Examiner*—Judy Nguyen
*Attorney, Agent, or Firm*—Fitzpatrick, Cella, Harper & Scinto

[57] ABSTRACT

A recording scan is performed through a relative reciprocation of color recording heads on a recording material. The recording heads can record with higher recording density than that of input image date. A plurality of pixels (2×2)are formed for each pixel of input image data. A mixed color image is recorded by multiple scans of the recording heads, in such a manner that pixels thereof (2×2) are not subjected to superposition of ink of two colors or more during a scan of the recording heads. Thus, it is possible to prevent an occurrence of variations in mixed color, and to record a high quality color image without increasing a recording time. Further, an amount of ink of one color may be reduced when recording a second one of the scans.

10 Claims, 10 Drawing Sheets

DENSITY

1ST SCAN
2ND SCAN
3RD SCAN

MULTIPLE SCAN MIXED COLOR INK JET RECORDING METHOD

This application is a continuation of application Ser. No. 08/125,203 filed Sep. 23, 1993, now abandoned.

BACKGROUND OF THE INVENTION

1. Field of the Invention

The present invention relates to an ink jet recording method of recording an image on a recording material by means of ejecting ink toward the recording material.

2. Related Background Art

Hitherto, there is known an ink jet printer for recording a color image by means of ejecting plural colors of ink toward a recording material such as a paper. In such a color ink jet printer, unlike a monochromatic printer for printing only characters, it is necessary to consider various factors such as color development ability, gradation and uniformity.

For example, to form on a recording medium a color image having colors other than the four colors, a plurality of colors of ink droplets are landed on the same position to mutually mix on the recording medium. FIGS. 6A and 6B show states of ink droplets at that time. In a case where a head is so arranged that it performs recording in order of black (K), cyan (C), magenta (M) and yellow (Y) in a forward scan, and in order of yellow (Y), magenta (M), cyan (C) and black (K) in a backward scan, with respect to the recording medium, for example; if green is recorded in the forward scan of a carriage, cyan is first landed on the recording medium and then yellow is landed. At that time, first, a cyan ink penetrates through the recording medium to spread on a surface and the inside. The subsequent landed yellow ink gets in under the cyan ink. It appears, viewing from the surface of the recording medium, that the yellow ink spreads outside the cyan ink. The cyan and yellow mixed color portion of the inside makes up green (G) and thus it is recognized through the naked eye that green is recorded. The state of this forward scan printing is shown in FIG. 6A.

On the contrary, in printing at the time of the backward scan, the cyan ink is landed after the yellow ink. Thus, the cyan ink gets in under the yellow ink, so that the yellow and cyan mixed color portion makes up yellow-dominating green (G') as shown in FIG. 6B. Hence, in spite of the same cyan and yellow mixed color, it is quite different between the forward printing and the backward printing, and a different mixed color appears for each new line. Consequently, hitherto, a 1-pass of color reciprocating printing has not been realized.

Further, with respect to the uniformity, the slight irregularity on fabrication of the print head in units of nozzles have an effect on an ejection amount of the nozzle and an ejection direction. Finally, it will be a cause of deterioration of image quality in the form of unevenness in density of printed image.

The unevenness in density due to irregularity in fabrication of the nozzles of such a multi-nozzle head will be described hereinafter.

In FIG. 7A, reference numeral 91 denotes a multihead for brief description, it is assumed that the multihead consists of 8 multi-nozzles 92. Reference numeral 93 denotes ink droplets ejected from the multi-nozzles 92. It is ideal that the ink droplets are ejected, as shown in the figure, in a uniform fashion with respect to an ejection amount and an ejection direction. Provided such an ideal ejection is carried out, the droplets will land on the paper as dots, as those shown in FIG. 7B, which are uniform in magnitude. Thus, it is possible to obtain a uniform image free from unevenness in density in its entirety (FIG. 7C).

But, as a matter of fact, as described before, the nozzles involve irregularity. Thus, if the printing is carried out in the same manner as the above, as shown in FIG. 8A, the ink droplets ejected from the respective nozzles involve disunity in magnitude and direction, so that they are landed on paper as shown in FIG. 8B. As seen from the figure, in this case, there are periodically found the presence of a blank portion failing to satisfy the area factor 100%, or unnecessary overlapping of the dots, and occurrence of the white stripe as seen at the center of the figure. A gathering of the dots landed in such a condition provides a density distribution shown in FIG. 8C with respect to a nozzle arrangement direction. As a result, it is visible as an uneven image density as far as seeing through the naked eye. In order to remove the drawbacks on the image due to disunity in an ejection amount and an ejection direction between the nozzles, there has been proposed a printing control method called a divisional recording method which will be described hereinafter.

FIG. 9 is a view useful for understanding such a divisional recording method. According to the divisional recording method, the multihead 91 performs the scan three times to complete the printing areas shown in FIGS. 7B and 8B. The half 4-pixel unit of area is completed in printing with a 2-pass. In this case, eight nozzles of the multihead are segmented into two groups consisting of upper 4 nozzles and lower 4 nozzles. A nozzle serves in the first scan to print dots corresponding to a specified image data thinned to about the half in accordance with a predetermined image data arrangement. At the second scan, the remaining half image data is filled up, so that the printing of 4-pixel unit of area is completed. The above-mentioned recording method is referenced to the divisional recording method. According to such a divisional recording method, even if the same recording head as that used in conjunction with the recording referred to in FIGS. 6A and 6B, influence of the respective nozzles on the print image is reduced to half, and thus the printed image as shown in FIG. 9B is obtained and the black stripe and white stripe do not easily stand out as seen in FIG. 8B. Consequently, an uneven image density is also remarkably improved in comparison with FIG. 8C as shown in FIG. 9C.

Specifically, to perform such a recording, in the first scan and the second scan, image data are segmented in such a way that they are mutually made up in accordance with a specified arrangement. Usually as such an image data arrangement (thinning pattern), it is common to use as shown in FIGS. 10A to 10C an image data arrangement just like an array staggered in units of pixels with respect to column and row. Accordingly, in unit print area (here, 4-pixel unit), the printing is completed with the first scan for printing a staggered array (or checker) and the second scan for printing a reversed staggered array (or reverse checker). FIGS. 10A to 10C are views useful for understanding how a specified area is recorded when the staggered and reversed staggered patterns are adopted, using the multihead having eight nozzles, similar to FIGS. 7A to 7C, FIGS. 8A to 8C and FIGS. 9A to 9C. First, in the first scan, the recording of the staggered pattern ○ is performed using the lower 4 nozzles (FIG. 10A). Next, in the second scan, a sheet feed is performed by the corresponding 4 pixels (the half of the head length), and the recording of the reversed staggered pattern (#) is performed (FIG. 10B). Further, in the third scan, again, the sheet feed is carried out by the corresponding 4 pixels (the half of the head length), and the recording of the staggered pattern ○ is performed (FIG. 10C). In this manner, the recordings of the staggered pattern and the reversed staggered pattern are alternately carried out in conjunction with the 4-pixel unit of sheet feed, thereby completing the 4-pixel unit of recording area for each scan.

If such a divisional recording scheme is applied to a color reciprocating recording system, it is possible to improve to some extent uneven image density due to irregularity of the nozzles and disunity in color due to order of ink landing, in comparison with the aforementioned 1-pass color reciprocating recording system.

However, according to such a divisional recording scheme, it is necessary to scan the same area plural number of times. This involves such drawbacks that a recording time is increased and a throughput goes down.

SUMMARY OF THE INVENTION

It is therefore, in view of the foregoing, an object of the present invention to provide an improved ink jet recording method.

It is another object of the present invention to provide an ink jet recording method capable of recording a high quality color image without increasing a recording time.

It is still another object of the present invention to provide an ink jet recording method in which when a recording means having a plurality of recording element arrays for ejecting mutually different color inks is relatively reciprocated with respect to a recording medium to perform scanning and recording, there is prevented occurrence of a variation in mixed color due to difference in ink overlap order between a forward scan and a backward scan.

The objects above and others of the present invention will become more apparent from the consideration of the following detailed description taken in conjunction with the accompanying drawings.

DESCRIPTION OF THE PREFERRED EMBODIMENTS

Preferred embodiments of the present invention will be described in detail with reference to the accompanying drawings.

Figure 4:
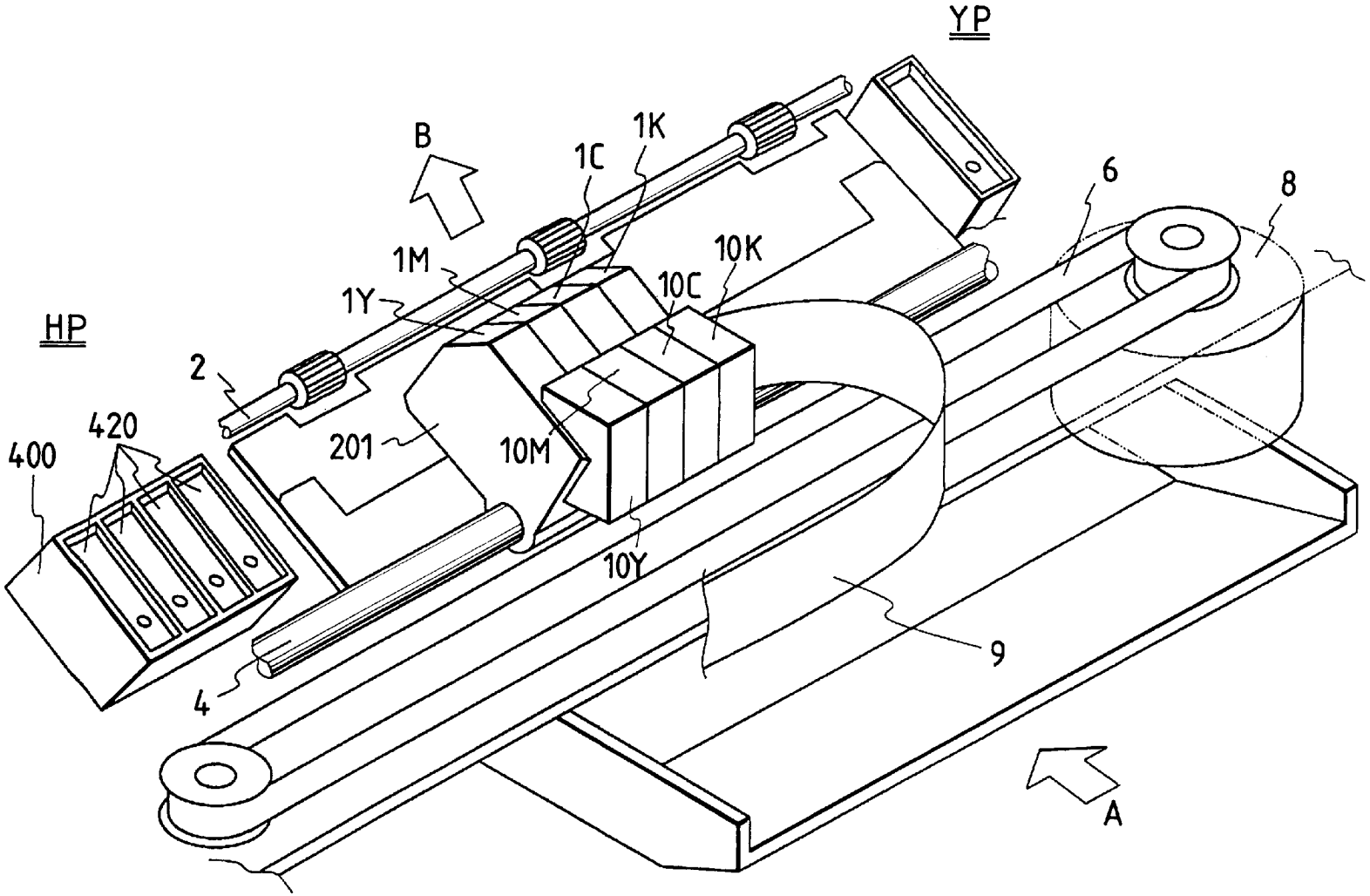
FIG. 4 is a perspective view showing a schematic arrangement of an ink jet recording apparatus to which the present invention is applicable.

FIG. 4 is a perspective view showing a schematic arrangement of an ink jet recording apparatus to which the present invention is applicable.

Each of print heads 1Y, 1M, 1C, 1K is a device provided with a nozzle array in which ink droplets are ejected from the nozzle array to perform image recording on a recording medium in dot formation. The different print heads eject different colors of ink droplets to form a color image on the recording medium by a mixed color of these ink droplets. According to the present embodiment, the print head ejects the ink droplets from orifices by means of inducing the status variation on ink using thermal energy. And the print head performs printing with 360 dpi of recording density. Printing data are transmitted through a cable 9 from an electric circuit of a printer main body to the print head. A print head array of 1K (black), 1C (cyan), 1M (magenta) and 1Y (yellow) is mounted on a carriage 201, and during one scan the ink is ejected in the named order of the print heads. For example, in case of the production for red (referred to as R hereinafter), first, magenta (referred to as M hereinafter) is landed on the recording medium, and then yellow (referred to as Y hereinafter) is landed on the dot of M, so that the mixed color is visible as a red dot. In a similar way, in case of the production for green (referred to as G hereinafter), in order of C and then Y; and in case of the production for blue (referred to as B hereinafter), in order of C and then M. The print heads are disposed at regular intervals (p1). Consequently, for example, in case of a solid printing of green G, cyan C is printed and thereafter yellow Y is printed with a delay of the corresponding 2* p1. That is, the solid printing of Y is performed on the solid printing of C. The carriage 201 performs a movement control in a main scan direction by detection of a scanning speed and a printing position of the carriage by a velocity detection means. A driving source for the carriage is a carriage driving motor 8, the driving force of which is transmitted through a belt 6 to the carriage, so that the carriage may travel on a sliding shaft. During a traveling operation in the main scan direction, printing as to a digit direction is performed. A printing operation as to the digit direction is executed by a one way printing or a two way printing. Usually, the one way printing serves to perform printing only when the carriage moves from a home position HP toward its opposite direction (forward direction), but does not perform printing when the carriage returns to the home position (backward direction). Thus, according to the one way printing, it is possible to expect highly accurate printing. On the contrary, the two way printing serves to perform printing in both the forward and backward directions. Thus, according to the two way printing, it is possible to expect high speed printing.

A recovery unit 400 has such a function that the print heads are always kept in good condition, and in a non-printing state, serves to close ejection surfaces of the print heads by a cap array 420, thereby preventing drying or the like. Thus, a position at which the carriage 201 is opposite to the recovery unit 400 is referred to as the home position HP.

The function of the recovery unit on printing will be explained. In actual printing, all the nozzles of one of the heads are not always used. Further, among plural colors of print heads, there may be present unused heads to which print data are transmitted. As described above, if there is a print head from which ink is not ejected during a certain period of time in a scan of the carriage (for the period the print head is not capped), the ejection performance for ink is degraded by hardening or drying on a surface of the print head, whereby deterioration of image quality may occur. In order to prevent this phenomenon, the print head performs ejection at regular time intervals using nozzles of the head so that the surface of the print head is kept optimum. This operation is referred to as a preliminary eduction. The ejecting ink according this preliminary eduction is ejected toward the caps 420 within the recovery unit 400 so as to avoid occurrence of the stains on the recording medium and on the inside of a printer due to the ink flying, and is saved in a waste ink tank (not illustrated) through a suction by a recovery pump (not illustrated).

Thus, when the preliminary ejection operation is performed in printing, it is necessary that the carriage 201 is returned to the home position HP in each of the one way printing and the two way printing so as to be opposite to the cap array 420. With respect to the feed in a subscan direction, a recording medium is fed by a sheet feed member (rubber roller or the like) driven by a sheet feed motor (not illustrated). The recording medium is supplied from the direction denoted by an arrow A in FIG. 4. The printing operation is carried out by the print head array when the recording medium reaches a print position. Thereafter, the recording medium is discharged through a delivery mechanism 2 in a direction denoted by an arrow B. The supply of ink is implemented from ink cassettes 10K, 10C, 10M and 10Y to the ink heads in units of colors.

Figure 5:
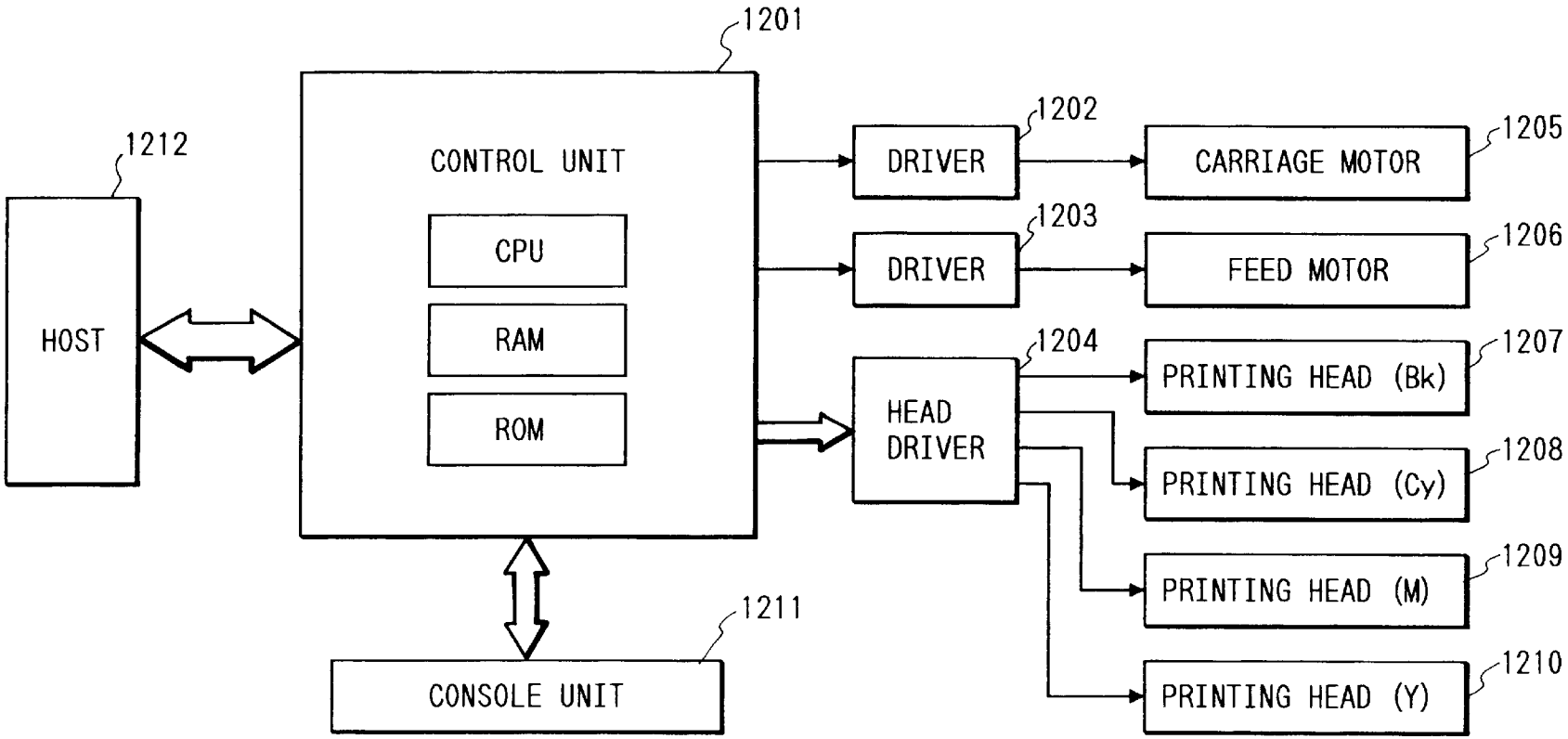
FIG. 5 is a block diagram of a control unit of the ink jet recording apparatus shown in FIG. 4.
Figure 6A:
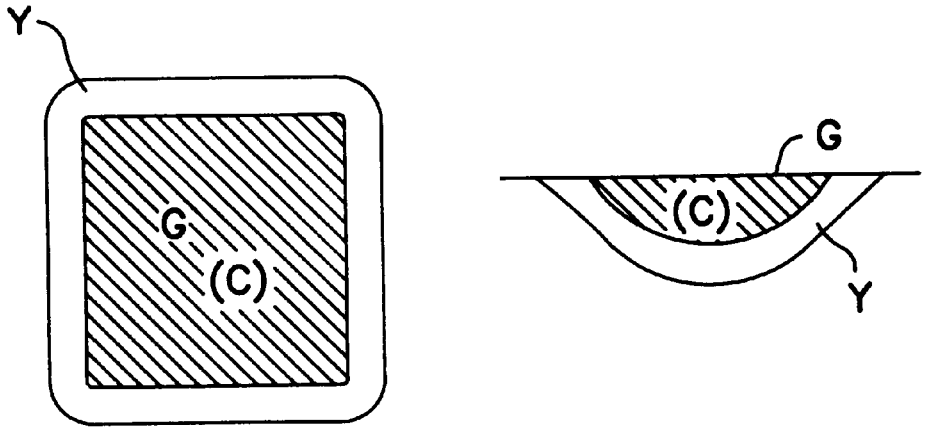
FIG. 6A PRIOR ART
FIGS. 6A and 6B are views useful for understanding the states of the recording of the mixed color image according to the conventional recording method.
Figure 6B:
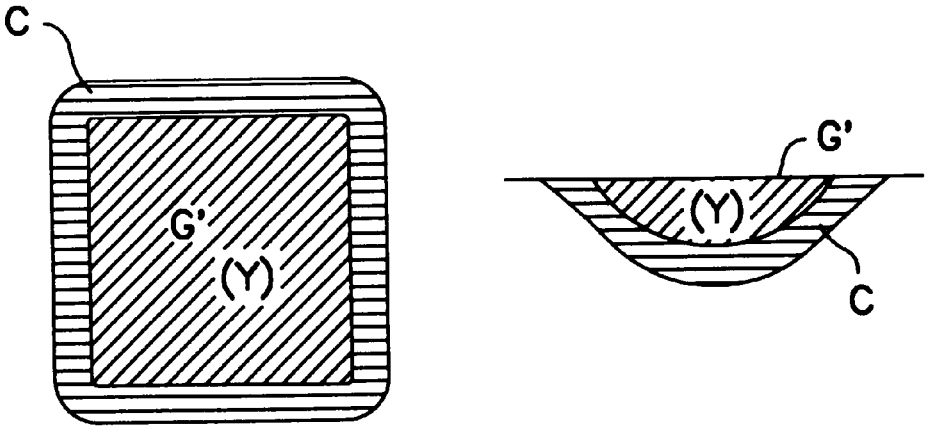
FIG. 6B PRIOR ART
Figure 7C:
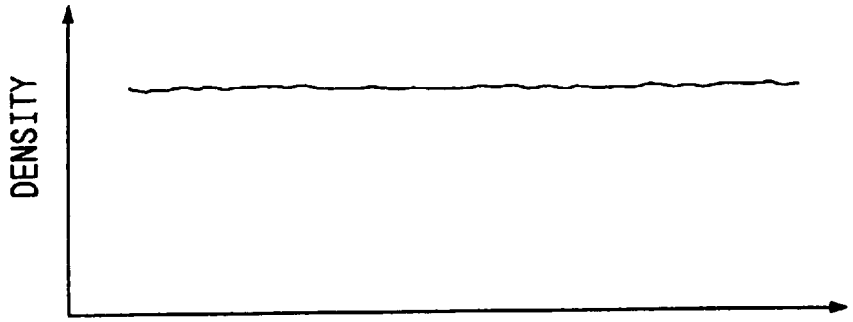
FIG. 7C PRIOR ART
FIGS. 7A to 7C are views useful for understanding ideal printing states according to an ink jet printer.
Figure 7B:
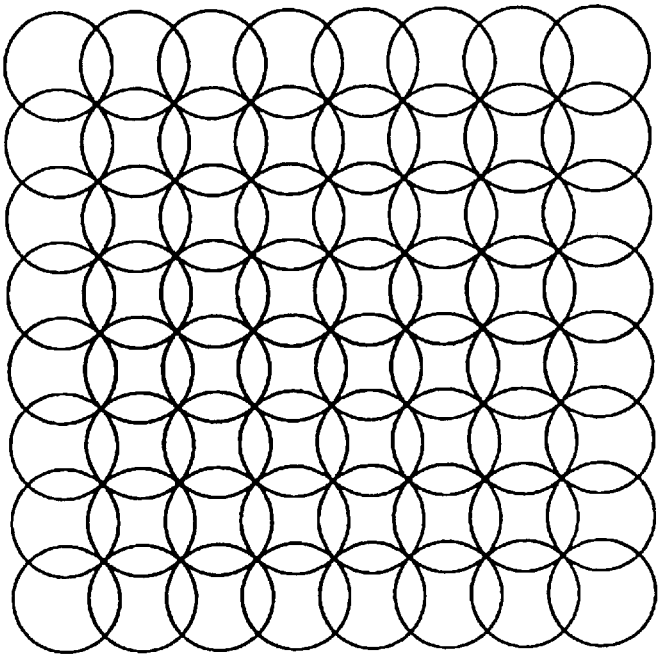
FIG. 7B PRIOR ART
Figure 7A:
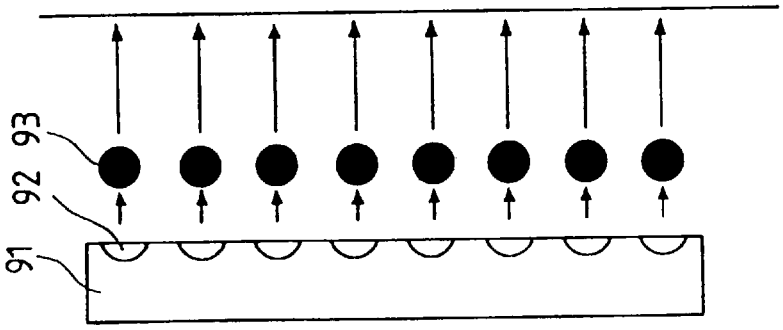
FIG. 7A PRIOR ART
Figure 8C:
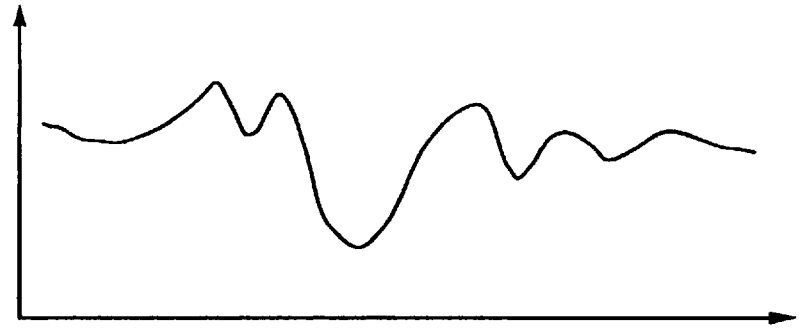
FIG. 8C PRIOR ART
FIGS. 8A to 8C are views useful for understanding printing states according to an ink jet printer involving uneven image density.
Figure 8B:
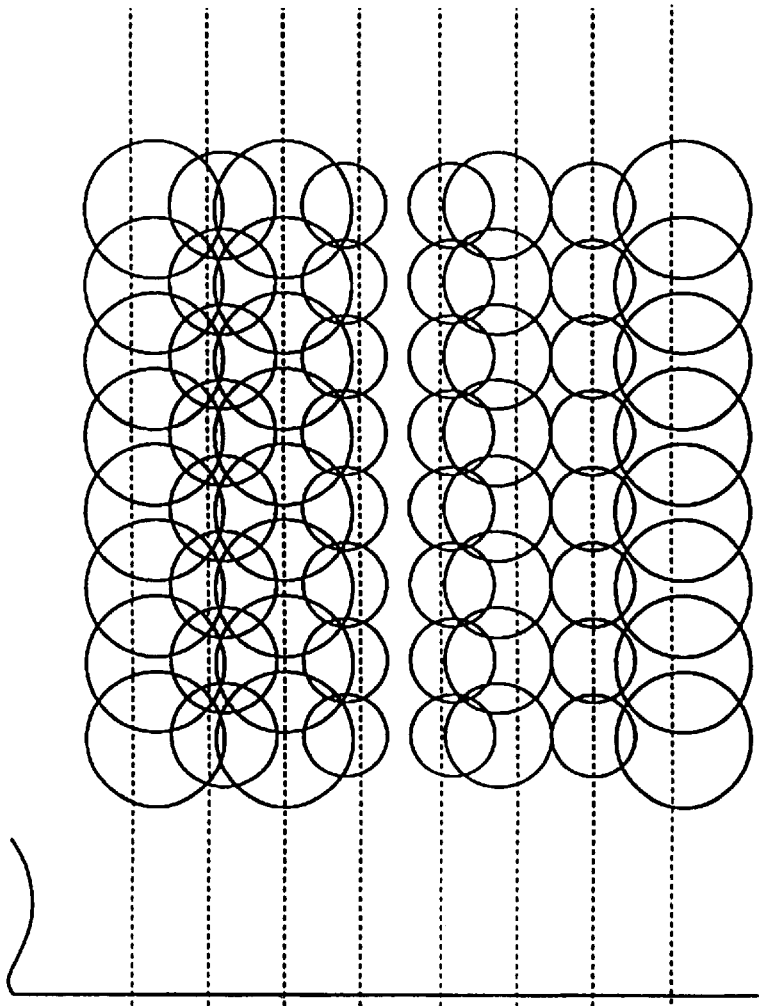
FIG. 8B PRIOR ART
Figure 8A:
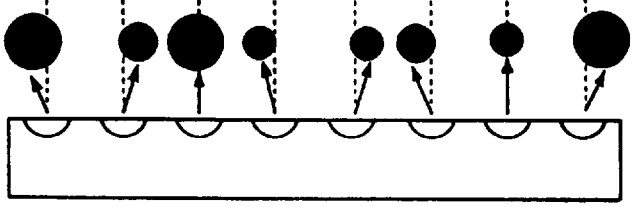
FIG. 8A PRIOR ART
Figures 9A, 9B, 9C:
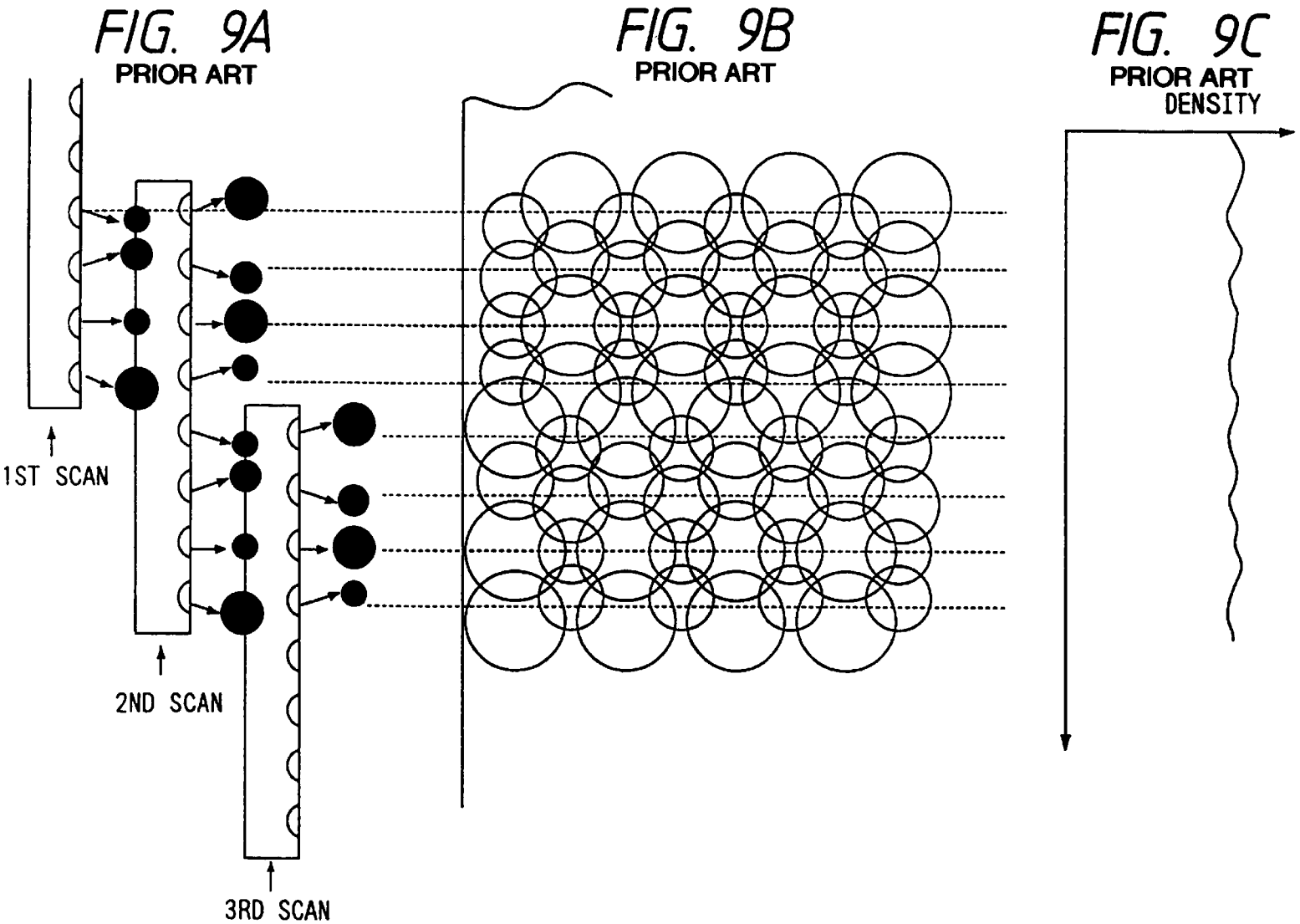
FIG. 9C PRIOR ART
FIG. 9B PRIOR ART
FIG. 9A PRIOR ART
FIGS. 9A to 9C are views useful for understanding a divisional recording.
Figure 10A:
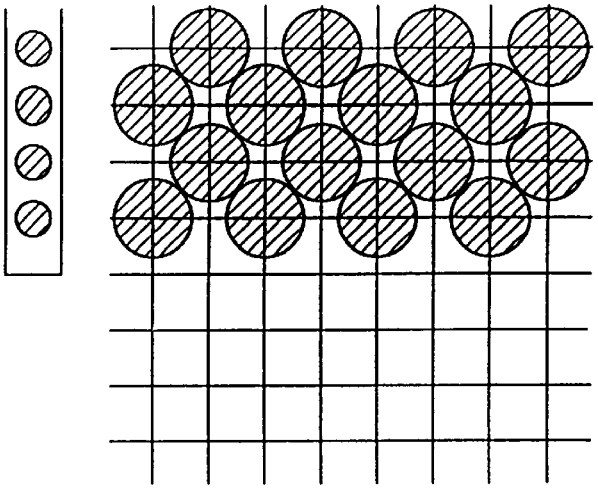
FIG. 10A PRIOR ART
FIGS. 10A to 10C are views useful for understanding printing states according to the divisional recording.
Figure 10B:
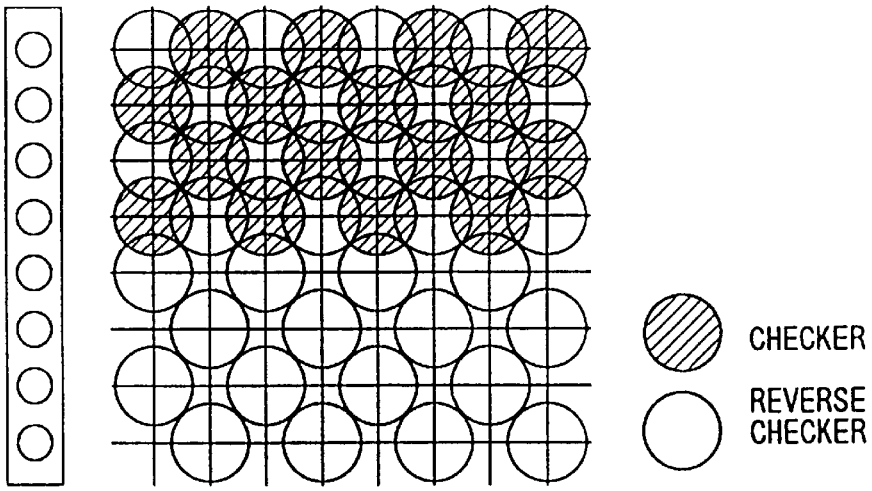
FIG. 10B PRIOR ART
Figure 10C:
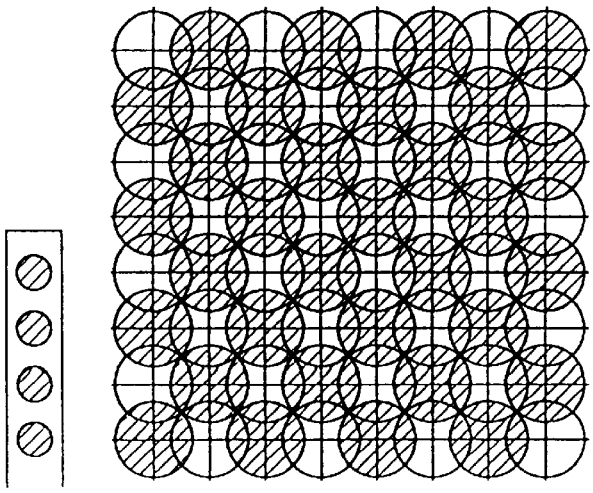
FIG. 10C PRIOR ART

FIG. 5 is a block diagram of a control unit of the ink jet recording apparatus shown in FIG. 4. In FIG. 5, reference numeral 1201 denotes a control unit, comprising a CPU, a ROM, a RAM and the like, for controlling the respective units of the apparatus in accordance with a program stored in the ROM. Reference numeral 1202 denotes a driver for driving a carriage motor 8 to move (main scan) a carriage 201 in a direction X on the basis of a signal from the control unit 1201; 1203 a driver for driving a feed motor 1206 to drive a paper feed roller (not shown) and a paper transfer roller (not shown) on the basis of a signal from the control unit 1201 and transmit a recording material in a direction Y (subscan); 1204 a head driver for driving color-print heads 1207–1210 (corresponding to print head array of 1K, 1C, 1M and 1Y in FIG. 4) on the basis of print data from the control unit 1201; 1211 a console unit for various key inputs and various displays; and 1212 a host equipment.

Upon receipt of a print start command, the carriage 201, which is at the home position before the printing start, moves forward in the direction X, while printing is performed on a paper by n nozzles on a multi-head (1Y, 1M, 1C, 1K). When printing for data is terminated at one end of the paper and the carriage reaches a turning position, the carriage starts a backward running in the home position direction and the printing for data is again carried out. A paper feed in the direction A is carried out according to the width of a recording area by means of rotating the paper transfer roller before the start of the second printing by the backward running of the carriage after completion of the first printing by the forward running of the carriage. In this manner, the printing by the multi-head according to the scan (main scan) of the carriage and the paper transfer (subscan) are repeatedly performed, and thus data printing on the paper is completed.

Embodiments of a recording method which is implemented in the ink jet recording apparatus as described above will be explained hereinafter.

First Embodiment

Figure 1:
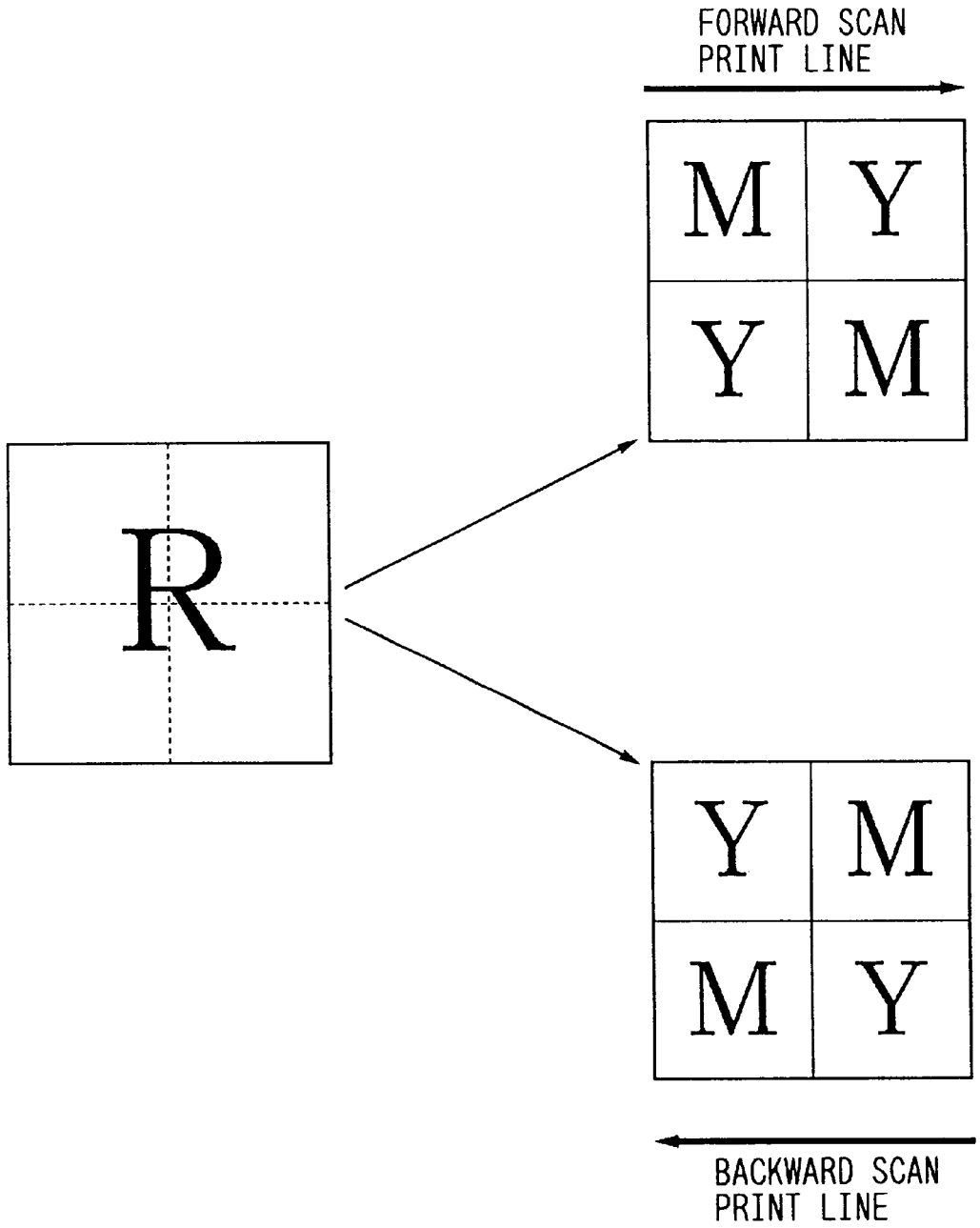
FIG. 1 is a view showing a mixed color divisional image according to the first embodiment of the present invention.

FIG. 1 shows a first embodiment in which there is used an ink jet recording head provided with a recording density twice as high as that of image data, and one pixel of image data, ie. one image pixel is segmented into 4 recording pixels on which the same recording is carried out. According to the present embodiment, image data of 180 dpi is recorded in 360 dpi of recording density.

In a case where a pixel of input image data is given with "R", the recording data is quadruple so as to provide 2×2 recording pixels, since the recording density is twice. Since the data is given with "R", it is segmented into "M" and "Y", and "M" and "Y" are disposed in 4 pixels fifty-fifty. While there are considered several combinations thereof, according to the present embodiment, "M" and "Y" are disposed in a diagonal relation. In case of a disposition of the head as shown in FIG. 4 in the forward scan, first, ink of "M" is ejected and then ink of "Y" is ejected to land on the recording medium (refer to the forward scan print line in FIG. 1). In a case where the ink droplets are landed as described above, a color mixing is not carried out on the same pixel. Thus, there will occur no variation in mixed color due to difference in order of ejection. Next, in case of the backward scan, the printing operation is performed in order of "Y" as the former ejection and "M" as the later ejection. In the backward scan print line in FIG. 1, the data arrangement is different from that in the forward scan. However, the same data arrangement as the forward scan is acceptable. The image data segmented in such a manner is very high in recording density as mentioned above. Thus, a gathering of adjacent dots of "M" and "Y" is recognized through the naked eye as "R". Similarly, division of the respective mixed colors "R", "G" and "B" may prevent a variation in mixed color due to the differences in ink penetration order, and in addition may permit reciprocation printing. This makes it possible to enhance a throughput in color printing.

Second Embodiment

Figure 2:
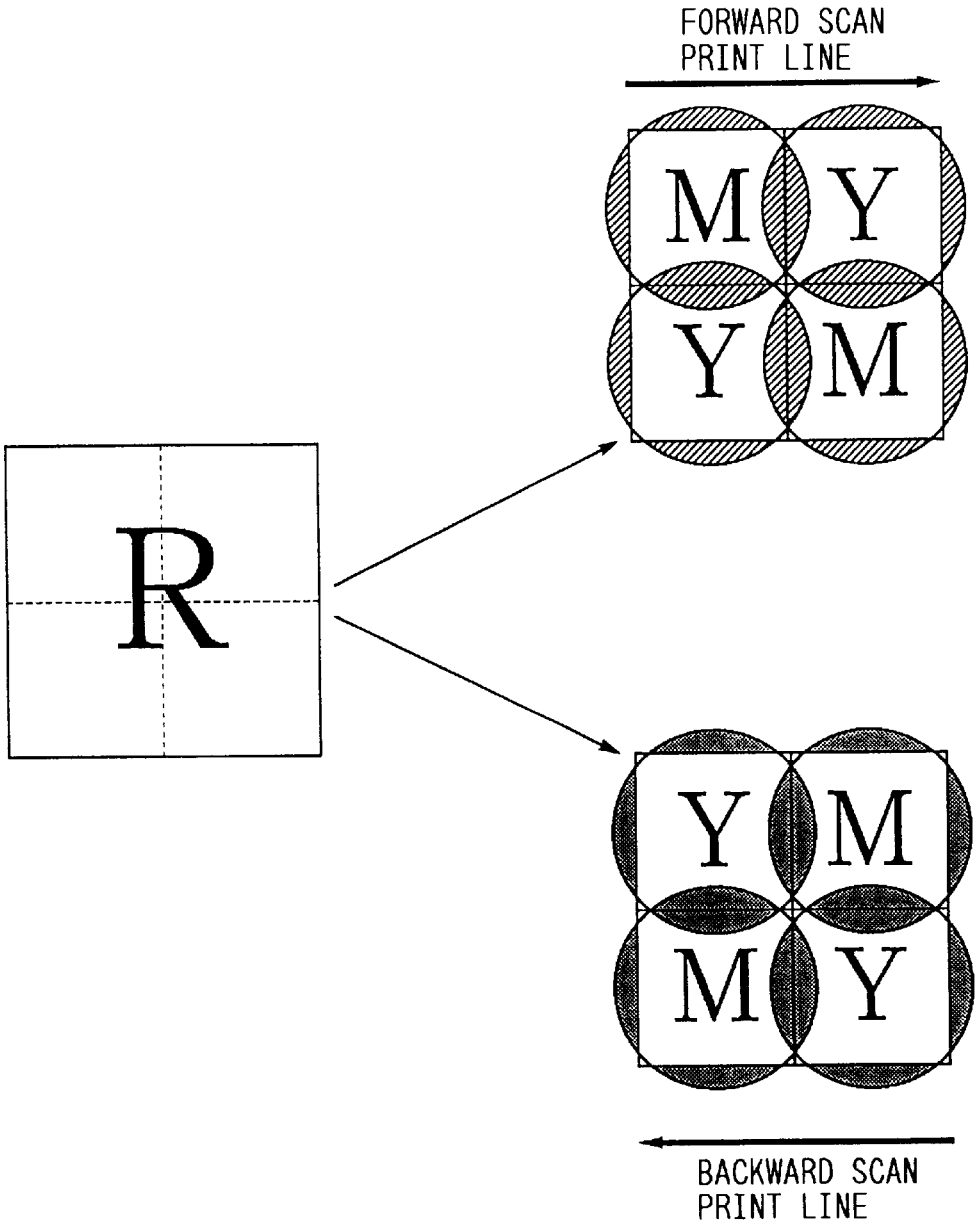
FIG. 2 illustrates a mixed color divisional image in case of a larger landing diameter.

FIG. 2 illustrates a mixed color divisional image in case of a larger ink ejection amount in the first embodiment. In the figure, there is shown a state in which ink ejection amounts of "M" and "Y" each are somewhat large, and boundaries of the respective color inks are coupled to each other thereby inducing mixed color. In the forward scan print line in FIG. 2, there is depicted by the oblique line portions a mixed color "R" which is in such a state that the later ejected "Y" gets in under the former ejected "M". In this case, ink boundaries of "M" and "Y" offer "M"-like "R" (oblique line portion). On the contrary, in the backward scan print line, ink boundaries of "Y" and "M" offer "Y"-like "R" (solid portions in the figure). That is, in case of the forward scan printing, there appears an "M"-dominating-"R" in hue, and in case of the backward scan printing, there appears a "Y"-dominating-"R" in hue.

Accordingly, in a case where an ink ejection amount on each ink color is relatively much in such an extent that a mixed color is induced at the boundaries, it is difficult to implement the 1-pass reciprocation printing even using a printer provided with a recording density higher than that of the input image. In view of this respect, according to the present embodiment, an ink ejection amount of the print head involved in the mixed color pixels is varied in units of reciprocating scans.

Figure 3:
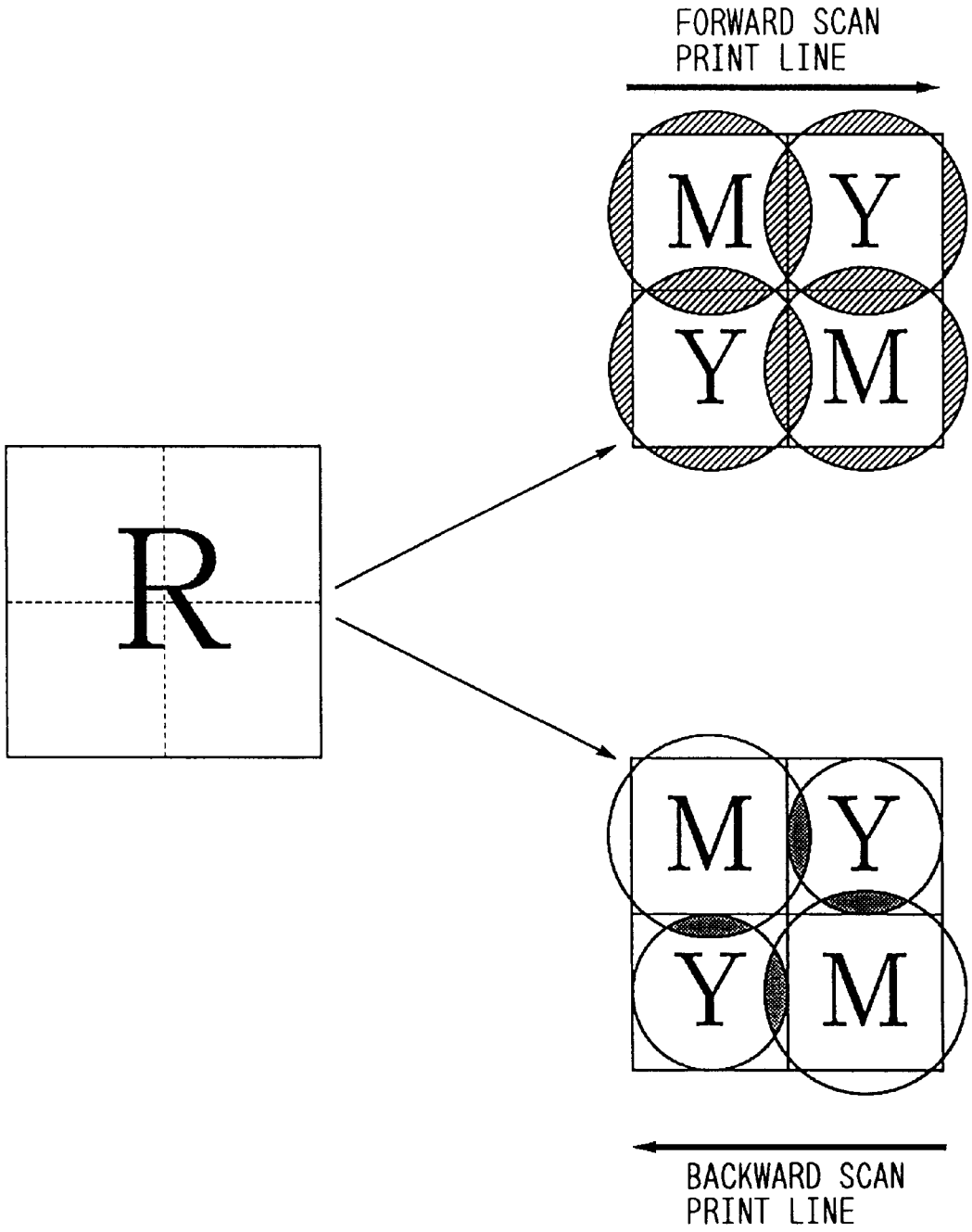
FIG. 3 is a view showing a landing state according to the second embodiment of the present invention.

FIG. 3 is a view showing a landing state according to the second embodiment of the present invention. According to the present embodiment, an ejection amount for ink "Y" in the backward scan print is reduced in comparison with that in the forward scan print (diameters of circles in the figure are representative of ink ejection amounts). In the forward scan print in FIG. 3, the preceding ink "M" is dominative at different color boundaries (oblique line portions). This is similar to FIG. 2. In the backward scan print in FIG. 3, an ejection amount of "Y" ink which is the subsequent ejection ink in the forward scan printing is reduced (smaller diameter portions in the figure), so that areas of the different color boundaries are reduced to fit a color made up in the backward scan printing to that in the forward scan printing. That is, an ejection amount of "Y" ink which is the preceding ejection ink in the backward scan printing is reduced, so that "M" ink which is the subsequent ejection ink in the backward scan printing does not get in under the "Y" ink, thereby maintaining it on the surface of the recording medium. This makes it possible to provide a color near "M" in the backward scan printing and possible to prevent variations in mixed color between the forward and backward scan printings.

As a control of the landing diameter involved in the second embodiment, there are considered a temperature control for the print head, and a control of an ink ejection amount by a pulse width modulation (PWM) control of a driving signal for ink ejection. According to the present embodiment, the print head 1 is driven by an electro-thermal transducer element to eject ink droplets, and a heater is used to keep the print head 1 at a predetermined temperature in order to control variation in temperature of the ink droplets due to an environmental temperature. According to the present embodiment, the more a temperature of the print head rises, the more an ink ejection amount increases. Thus, if the temperature to be kept is controlled to vary between the forward scan and the backward scan of the print head, an ink ejection amount varies in accordance with a scan direction of the carriage. According to the prior art, the temperature to be kept of the print head 1 is set to 36° C. In view of this, for example, in the forward scan print, both the M and Y heads perform ink ejection on the condition of the temperature to be kept at 36° C., and in the reverse scan print, the temperature to be kept of the Y head is set up to be lower than that of the M head so as to reduce areas of mixed color boundaries. The use of such an ink ejection amount control means controls an ink landing diameter on the recording medium. Further, it is known to vary an ink ejection amount by a driving control scheme of a heater for ink ejection. For example, a method of regulating an ink ejection amount, in which a number of pre-heat pulses or a heat width in a multi-pass driving is modulated, is also applicable to the present embodiment.

Thus, it is possible to implement a 1-pass reciprocating print, without occurrence of variations in mixed color, by means of recording the mixed colors R, G and B in such a manner that their dot positions each are not subjected to superposition of ink of two colors or more, as described above, in the recording apparatus provided with a recording density higher than that of the input pixel. Further, in a case where the mixed colors appear at different color boundaries when a landing dot's diameter is large, and the variations in mixed color occur between the forward scan print and the backward scan print, the occurrence of such variations in mixed color can be avoided by means of performing a printing operation with a smaller landing diameter of an ink dot in the backward scan in comparison with that in the forward scan. This permits the 1-pass reciprocating print, and thus it is possible to enhance a throughput of the color printer.

The present invention brings about excellent effects particularly in a recording apparatus of the ink jet system for performing recording by forming flying ink droplets by utilizing heat energy, among the ink jet recording systems. The typical structure and operational principle are preferably the ones disclosed in U.S. Pat. Nos. 4,723,129 and 4,740,796. This system is applicable to either a so-called on-demand type recording system or a continuous type recording system. Particularly, this system is effectively applicable to the on-demand type system for the following reason. When at least one driving signal that corresponds to recording information, and can give abrupt temperature rise exceeding nucleate boiling is applied to an electrothermal converting element arranged in correspondence with a sheet or liquid channel, which holds an ink, the electrothermal converting element generates heat energy, the heat energy causes film boiling on a heat acting surface of a recording head, and consequently, a bubble can be formed in the liquid (ink) in one-to-one correspondence with the driving signal. Upon growth and contraction of this bubble, the liquid (ink) is ejected through an ejection orifice, thereby forming at least one droplet. It is more preferable to define this driving signal to have a pulse waveform since a bubble can grow and contract instantaneously, and in particular, the liquid (ink) can be ejected in a short response time.

As the driving signal having the pulse waveform, signals disclosed in U.S. Pat. Nos. 4,463,359 and 4,345,262 are suitable. Further excellent recording can be realized when conditions disclosed in U.S. Pat. No. 4,313,124 of the invention associated with the temperature rise rate of the heat acting surface are adopted.

As the structure of the recording head, in addition to a structure (linear liquid channel or a right-angle liquid channel) as a combination of ejection orifices, liquid channels, and electrothermal converting elements disclosed in the above-mentioned specifications, structures disclosed in U.S. Pat. Nos. 4,558,333 and 4,459,600 disclosing a structure having a heat acting structure arranged in a flexed region may be used.

In addition, the recording head maybe arranged based on Japanese Laid-Open Patent Application No. 59-123670 that discloses a structure wherein a common slit is used as an ejection portion for a plurality of electrothermal converting elements, or Japanese Laid-Open Patent Application No. 59-138461 that discloses a structure wherein an opening for absorbing a pressure wave of heat energy is formed in correspondence with the ejection portion.

Furthermore, as a full-line type recording head having a length corresponding to the maximum width of a recording medium, which can be used in recording of a recording apparatus, either a structure which satisfies this length by combining a plurality of recording heads or a structure as an integrally formed single recording head may be employed.

In addition, an exchangeable chip type recording head, which enables electrical connection to the apparatus main body or the supply of ink from the apparatus main body by being mounted onto the apparatus main body, or a cartridge type recording head, which has an ink tank provided integrally on the recording head itself, may be used.

It is preferable to add a recovery means, a preliminary auxiliary means, and the like for the recording head since they can further stabilize the effect of the present invention. For example, such recovery means includes capping means and cleaning means for the recording head, pressing or suction means, and preheating means which may comprise an electrothermal converting element, or another heating element, or a combination thereof. In addition, it is also effective to execute a preliminary ejection mode independently of a recording mode since recording can be stabilized.

Moreover, in the embodiments of the present invention, an ink is described as a liquid. Alternatively, the present invention may employ an ink which is solidified at room temperature or less, and is softened or liquefied at room temperature, or an ink, which is liquefied upon application of a use recording signal since it is a general practice to perform temperature control of the ink itself within a range between 30° C. and 70° C. in an ink jet system so that the ink viscosity can fall within a stable ejection range.

In addition, the ink jet recording apparatus of the present invention may be used as an image output terminal of an information processing equipment such as a computer, or a copying machine as a combination of the recording apparatus, a reader, and the like, or a facsimile apparatus having a transmission/reception function.

The present invention is applicable to an ink jet system utilizing piezo elements and the like as well as that utilizing the thermal energy.

In the reciprocating recording, there are provided a plurality of recording pixels for a pixel of input image data, and the mixed color of image are recorded in such a manner that their pixels each are not subjected to superposition of ink of two colors or more. Thus, it is possible to prevent an occurrence of variations in mixed color, and to record a high quality color image without increasing a recording time.

What is claimed is:

1. A method of recording a mixed color image of a first color and a second color on a recording material in accordance with input image data including at least two image pixels by effecting movement of a plurality of recording heads, each having an array of a plurality of recording elements, relative to the recording material, the plurality of recording heads for effecting recording at a higher recording density than a density of the input image data such that a plurality of recording pixels are recorded for each image pixel of the input image data, said method comprising the steps of:

performing a first recording scan by moving the plurality of recording heads relative to the recording material in a first direction, wherein ink droplets of the first color are ejected from a first recording head for first predetermined recording pixels of the plurality of recording pixels corresponding to an image pixel of the input image data prior to ejection of ink droplets of the second color from a second recording head to first remaining recording pixels of the plurality of recording pixels, and wherein ink droplets of the first color are substantially a same size as ink droplets of the second color;

moving the recording material in a sub-scan direction relative to the plurality of recording heads; and performing a second recording scan, after completion of the first recording scan, by moving the plurality of recording heads relative to the recording material in a second direction opposite to the first direction, wherein in the second recording scan, ink droplets of the second color are ejected from the second recording head for second predetermined recording pixels of the plurality of recording pixels corresponding to another image pixel of the input image data prior to ejection of ink droplets of the first color from the first recording head for second remaining recording pixels of the plurality of recording pixels and wherein in the second recording scan an amount of ink of the second color ejected from the second recording head is smaller than an amount of ink of the first color ejected from the first recording head.

2. An ink jet recording method according to claim 1, wherein a size of a dot formed on the recording material by each of the ink droplets provided for the recording pixels of the second color differs between the first recording scan and the second recording scan.

3. An ink jet recording method according to claim 2, wherein a size of the dot formed in the second recording scan for the second color is smaller than a size of a dot formed in the first recording scan.

4. An ink jet recording method according to claim wherein each of said recording elements ejects an ink droplet by generating film boiling in the ink using thermal energy to cause a change in state of the ink.

5. An ink jet recording method for recording a mixed color image of a first color and a second color on a recording material in accordance with input image data including at least two image pixels by effecting movement of a plurality of recording heads in a first recording scan direction relative to the recording material, and in a second recording scan direction opposite to the first recording scan direction, the plurality of recording heads having plural arrays each having a plurality of recording elements, the recording elements of each array ejecting different colored inks, the arrays being arranged in the recording scan direction, the plurality of recording heads effecting recording at a higher recording density than a density of the input image data such that a plurality of recording pixels are recorded for each image pixel of the input image data, said method comprising the steps of:

performing a first recording scan by moving the plurality of recording heads relative to the recording material in the first recording scan direction, wherein ink droplets of the first color are ejected from the recording elements for first predetermined recording pixels of the plurality of recording pixels corresponding to an image pixel of the input image data, and ink droplets of the second color are ejected for first remaining recording pixels of the plurality of recording pixels for the image pixel, and wherein ink droplets of the second color are not ejected for the first predetermined recording pixels, and ink droplets of the first color are not ejected for the first remaining recording pixels;

moving the recording material in a sub-scan direction relative to the plurality of recording heads; and performing a second recording scan, after completion of said first recording scan, by moving the plurality of recording heads relative to the recording material in the second recording scan direction, wherein ink droplets of the second color are ejected from the recording elements for second predetermined recording pixels of the plurality of recording pixels corresponding to another image pixel of the input image data, and ink droplets of the first color are ejected from the recording elements for second remaining recording pixels of the plurality of recording pixels, and wherein ink droplets of the first color are not ejected for the second predetermined recording pixels and ink droplets of the second color are not ejected for the second remaining recording pixels, wherein an arrangement of the first predetermined recording pixels and the first remaining recording pixels is different from an arrangement of the second predetermined recording pixels and the second remaining recording pixels.

6. An ink jet recording method according to claim 5, wherein each of the recording elements ejects an ink droplet by generating film boiling in the ink using thermal energy to cause a change in state of the ink.

7. An ink jet recording method according to claim 5, wherein a size of a dot formed on the recording material by each of the ink droplets provided for the recording pixels of the second color differs between said first recording scan and said second recording scan.

8. An ink jet recording method according to claim 7, wherein each of said recording elements ejects an ink droplet by generating film boiling in the ink using thermal energy to cause a change in state of the ink.

9. An ink jet recording method according to claim 7, wherein a size of a dot formed in said second recording scan is smaller than a size of a dot formed in said first recording scan.

10. An ink jet recording method according to claim 9, wherein each of the recording elements ejects an ink droplet by generating film boiling in the ink using thermal energy to cause a change in state of the ink.

* * * * *

UNITED STATES PATENT AND TRADEMARK OFFICE

CERTIFICATE OF CORRECTION

PATENT NO. : 5,992,972

DATED : November 30, 1999

INVENTOR(S): SHIGEYASU NAGOSHI, ET AL.

It is certified that error appears in the above-identified patent and that said Letters Patent is hereby corrected as shown below:

On the title page: Item

References Cited [56]

FOREIGN PATENT DOCUMENTS

"01281944" should read --1-281944--.

ABSTRACT [57]

"date." should read --data.--.

COLUMN 1

Line 51, "have" should read --has--.

COLUMN 8

Line 38, "maybe" should read --may be--.

UNITED STATES PATENT AND TRADEMARK OFFICE

CERTIFICATE OF CORRECTION

PATENT NO. : 5,992,972

DATED : November 30, 1999

INVENTOR(S): SHIGEYASU NAGOSHI, ET AL.

It is certified that error appears in the above-identified patent and that said Letters Patent is hereby corrected as shown below:

COLUMN 10

Line 10, "claim" should read --claim 1,--.

Signed and Sealed this

Seventh Day of November, 2000

*Attest:*

Q. TODD DICKINSON

*Attesting Officer*

*Director of Patents and Trademarks*